US011939764B2

(12) United States Patent
Kato

(10) Patent No.: US 11,939,764 B2
(45) Date of Patent: Mar. 26, 2024

(54) VENTILATION MEMBER AND WALL MATERIAL CONSTRUCTION STRUCTURE

(71) Applicant: NICHIHA CORPORATION, Nagoya (JP)

(72) Inventor: Teruyuki Kato, Nagoya (JP)

(73) Assignee: NICHIHA CORPORATION, Nagoya (JP)

( * ) Notice: Subject to any disclaimer, the term of this patent is extended or adjusted under 35 U.S.C. 154(b) by 196 days.

(21) Appl. No.: 17/695,610

(22) Filed: Mar. 15, 2022

(65) Prior Publication Data

US 2022/0205236 A1 Jun. 30, 2022

Related U.S. Application Data

(63) Continuation of application No. PCT/JP2020/037049, filed on Sep. 30, 2020.

(51) Int. Cl.
*E04B 1/70* (2006.01)
*E04B 1/64* (2006.01)

(52) U.S. Cl.
CPC ..... *E04B 1/7076* (2013.01); *E04B 1/64* (2013.01)

(58) Field of Classification Search
CPC . E04B 1/7076; E04B 1/64; E04B 1/66; E04B 2/00; E04F 13/0826; E04F 19/061;
(Continued)

(56) References Cited

U.S. PATENT DOCUMENTS 9,458,624 B2 * 10/2016 Colyn ..... E04F 13/0803
10,280,612 B2 5/2019 Kambe
(Continued)

FOREIGN PATENT DOCUMENTS

JP S57-178606 U 11/1982
JP S58-44306 U 3/1983
(Continued)

OTHER PUBLICATIONS

Communication and Supplementary European Search Report for corresponding European Patent Application No. 20871157.2 dated Jul. 11, 2023 (8 sheets).
(Continued)

*Primary Examiner* — Rodney Mintz
(74) *Attorney, Agent, or Firm* — Kratz, Quintos & Hanson, LLP

(57) ABSTRACT

Provided is a ventilation member suitable for ensuring the ventilation of a ventilation layer provided on the back side of a wall material. A ventilation member X according to the present invention is a ventilation member that can be attached to a wall material, and includes a fixed plate portion 10, a top plate portion 20, a partition plate portion 30, a bottom plate portion 40, a front plate portion 50, and a first baffle plate portion 61. The fixed plate portion 10 has a first surface that abuts against a building framework, and a second surface on a side opposite to the first surface, and includes a first end portion 13 located on one side in a state in which the ventilation member X is attached to the wall material, and a second end portion 14 located on another side. The top plate portion 20 extends from the first end portion 13 of the fixed plate portion 10 on the second surface side. The partition plate portion 30 extends from the top plate portion 20 in a direction from the first end portion toward the second end portion of the fixed plate portion 10. The bottom plate portion 40 extends from the partition plate portion 30 in a direction away from the fixed plate portion 10. The front plate portion 50 extends from the bottom plate portion 40 in a direction from the second end portion toward the first end portion of the fixed plate portion 10. The first baffle plate portion 61 extends from the front plate portion 50 to the partition plate portion 30 side. The bottom plate portion 40 has a first hole 42. A wall material construction
(Continued)

structure Y1 according to the present invention includes such a ventilation member X.

13 Claims, 10 Drawing Sheets

(58) Field of Classification Search
CPC .. E04F 13/0803; F24F 7/00; F24F 2007/0025
See application file for complete search history.

(56) References Cited

U.S. PATENT DOCUMENTS

| | | | | |
|---|---|---|---|---|
| 2015/0135626 | A1* | 5/2015 | Colyn | E04B 1/38 52/699 |
| 2018/0179753 | A1* | 6/2018 | Kambe | E04B 1/7076 |

FOREIGN PATENT DOCUMENTS

| | | | |
|---|---|---|---|
| JP | S64-01371 | Y2 | 1/1989 |
| JP | H10-252256 | A | 9/1998 |
| JP | 2002-317549 | A | 10/2002 |
| JP | 2010-001732 | A | 1/2010 |
| JP | 2011-052415 | A | 3/2011 |
| JP | 2011-202477 | A | 10/2011 |
| JP | 2012-067551 | A | 4/2012 |
| JP | 2012-225062 | A | 11/2012 |
| JP | 2012-225064 | A | 11/2012 |
| JP | 2013-044086 | A | 3/2013 |
| JP | 2013-044129 | A | 3/2013 |
| JP | 2014-031640 | A | 2/2014 |
| JP | 2014-156704 | A | 8/2014 |
| JP | 2015-113675 | A | 6/2015 |
| JP | 2015-113676 | A | 6/2015 |
| JP | 2016-053257 | A | 4/2016 |
| JP | 2017-020251 | A | 1/2017 |
| JP | 2017-133274 | A | 8/2017 |
| JP | 2017-197961 | A | 11/2017 |
| JP | 2018-044341 | A | 3/2018 |
| JP | 2018-053704 | A | 4/2018 |
| JP | 2018-080478 | A | 5/2018 |
| JP | 2018-091002 | A | 6/2018 |
| JP | 2018-104969 | A | 7/2018 |

OTHER PUBLICATIONS

International Search Report for International Application No. PCT/JP2020/037049 dated Dec. 8, 2020 (3 sheets).

* cited by examiner

[FIG. 1]
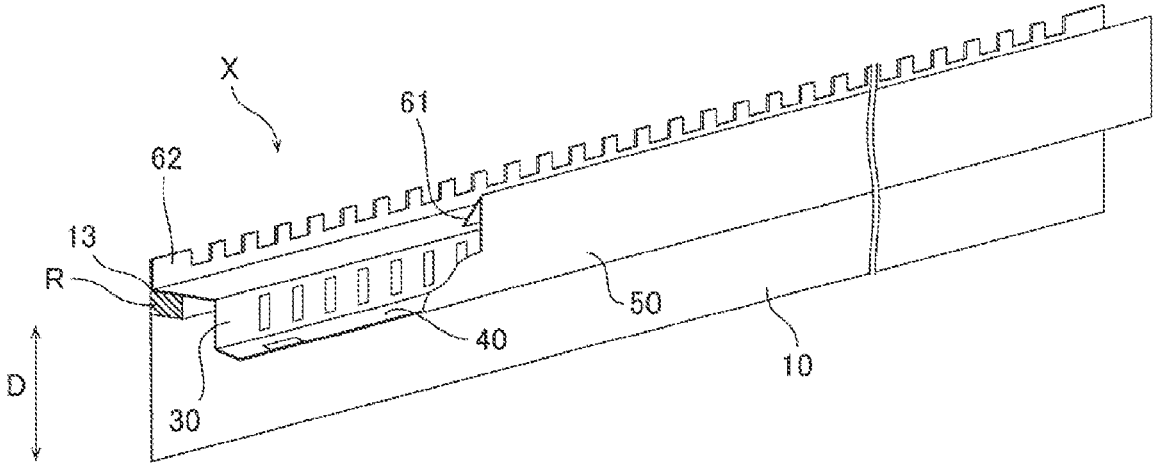
[FIG. 2]
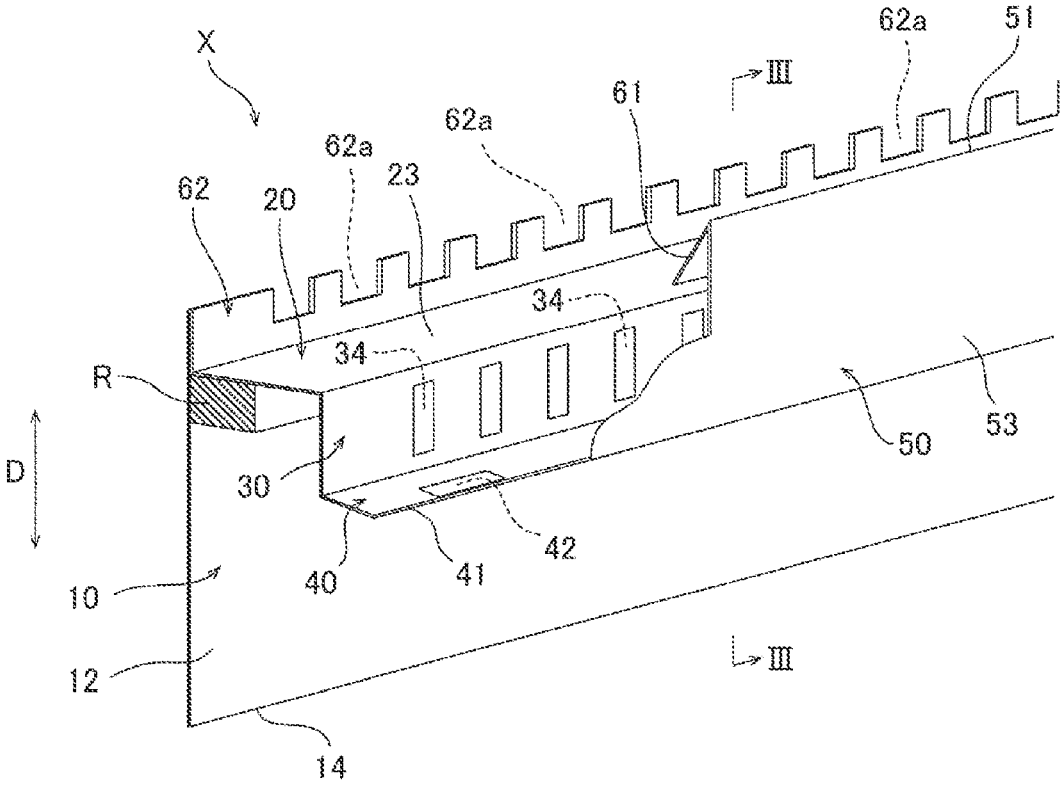

[FIG. 3]
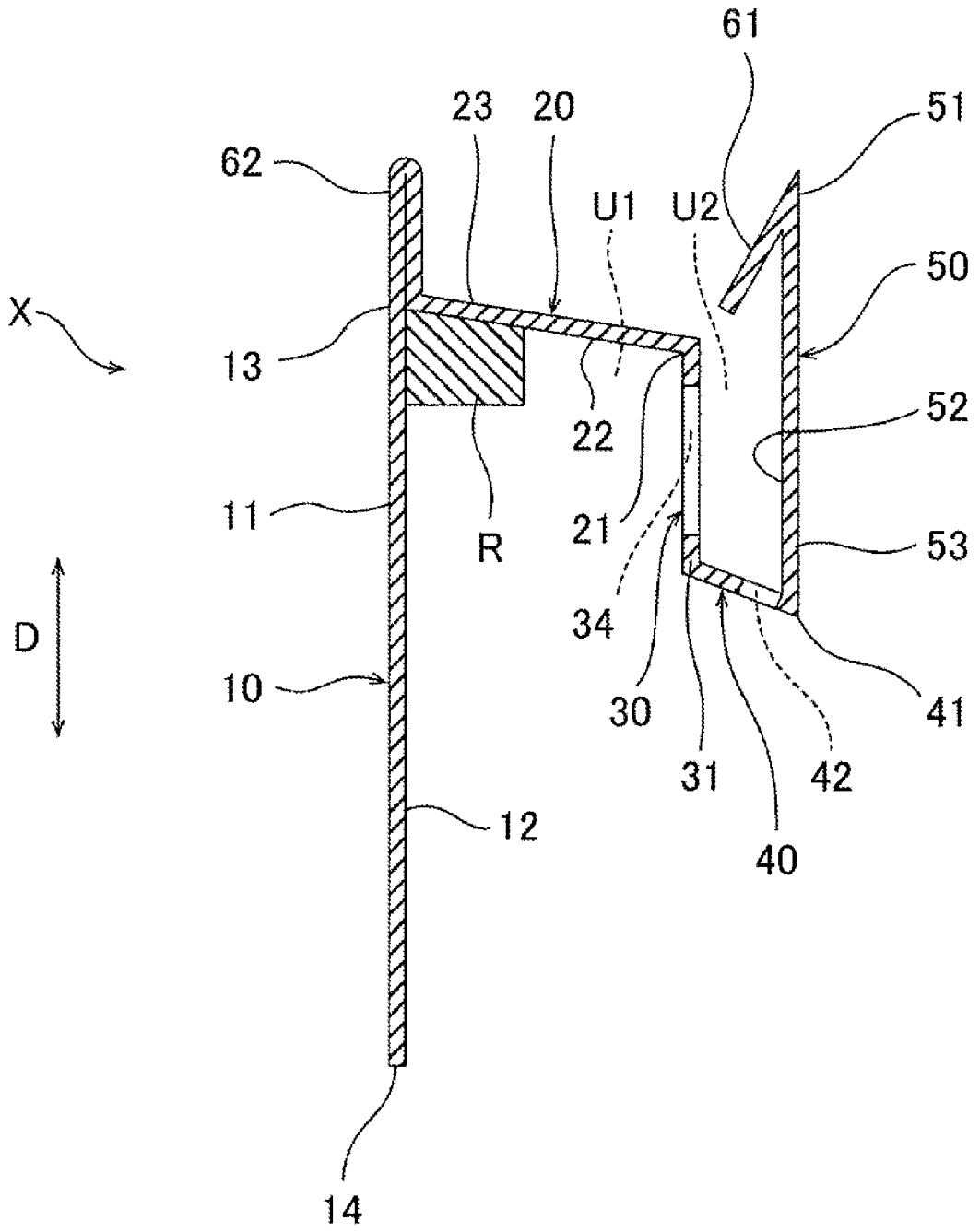

[FIG. 4]
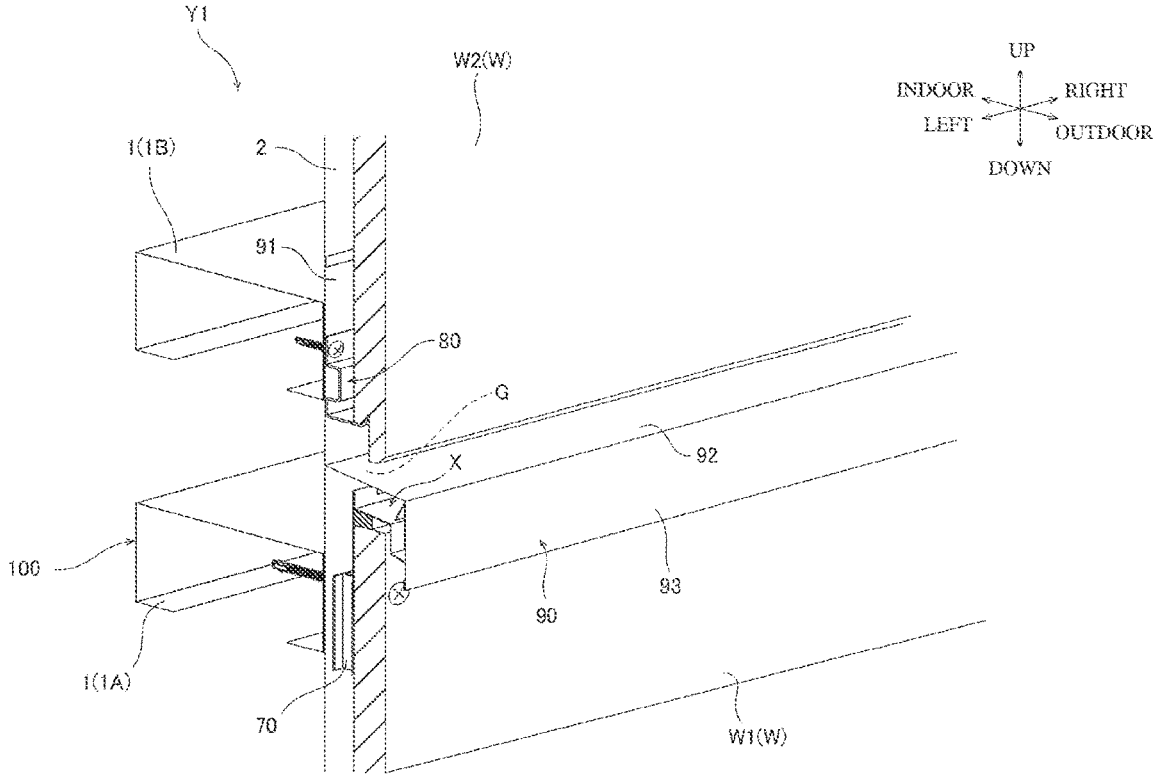

[FIG. 5]
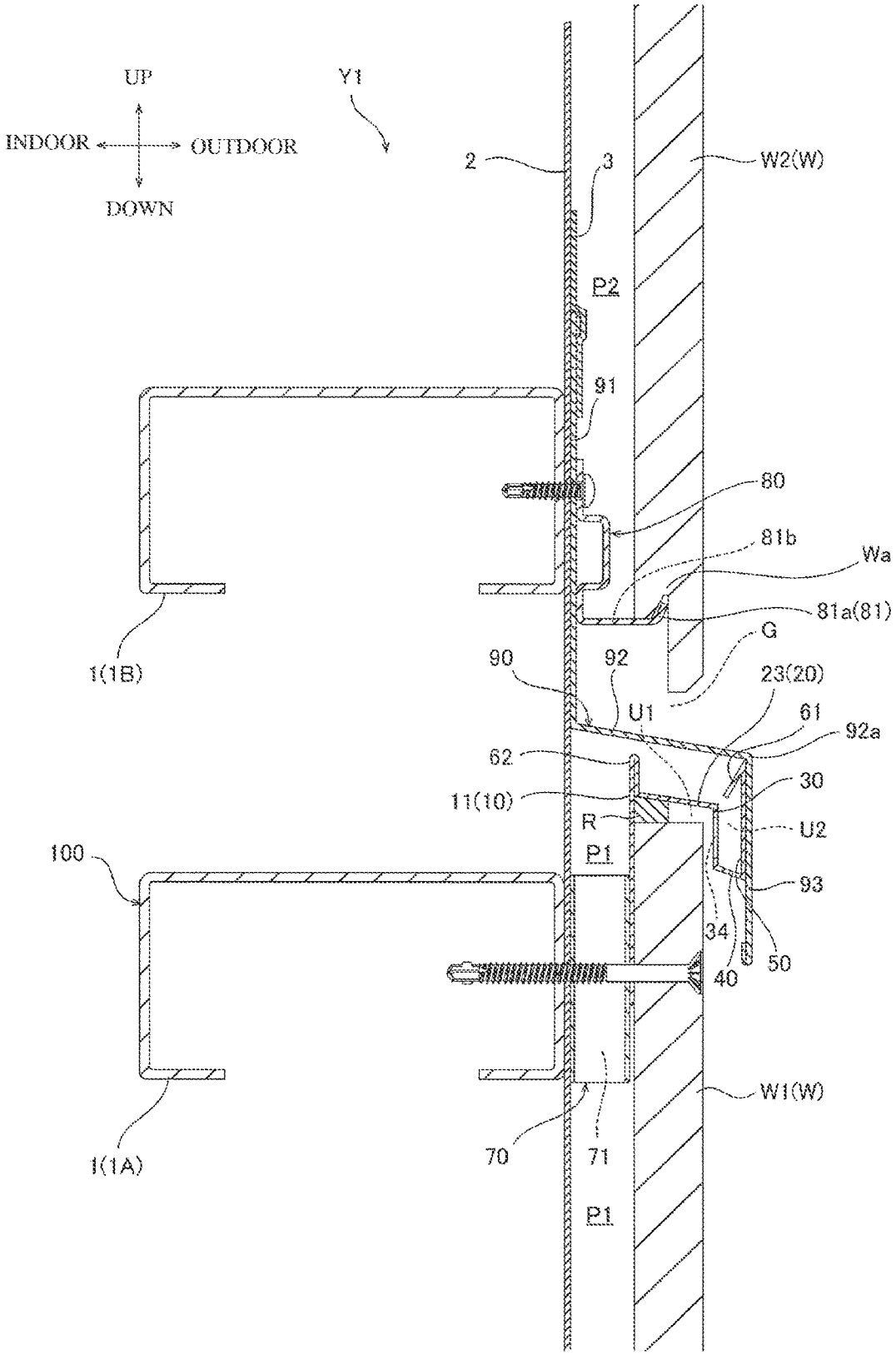

[FIG. 6]
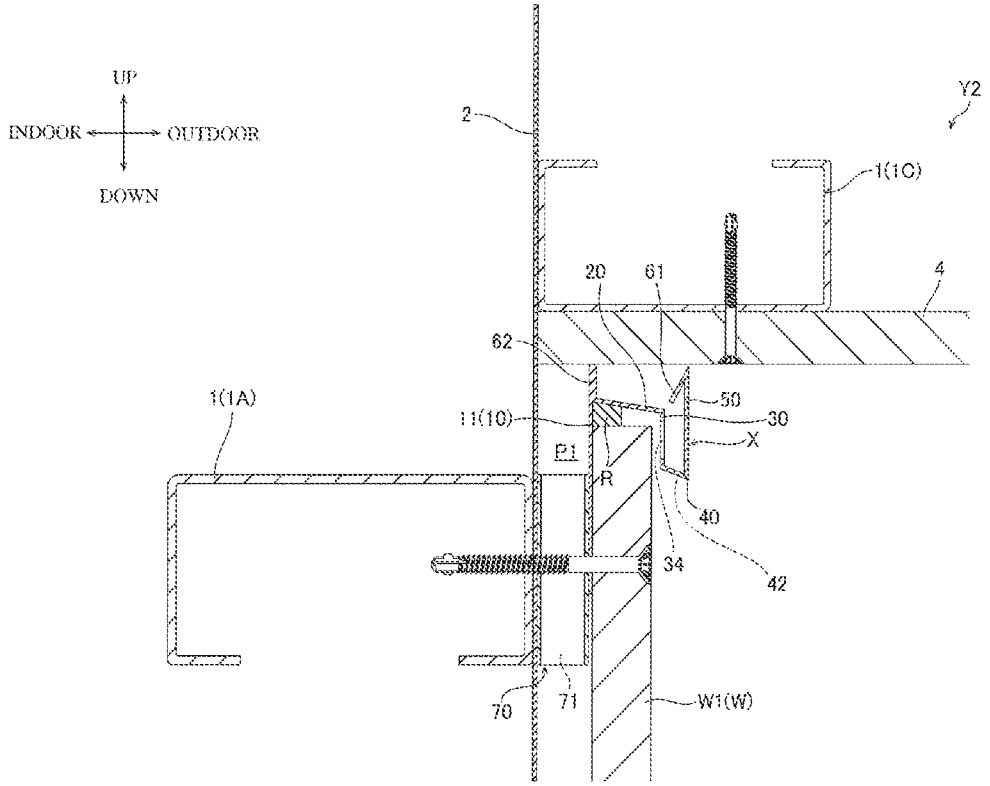

[FIG. 7]
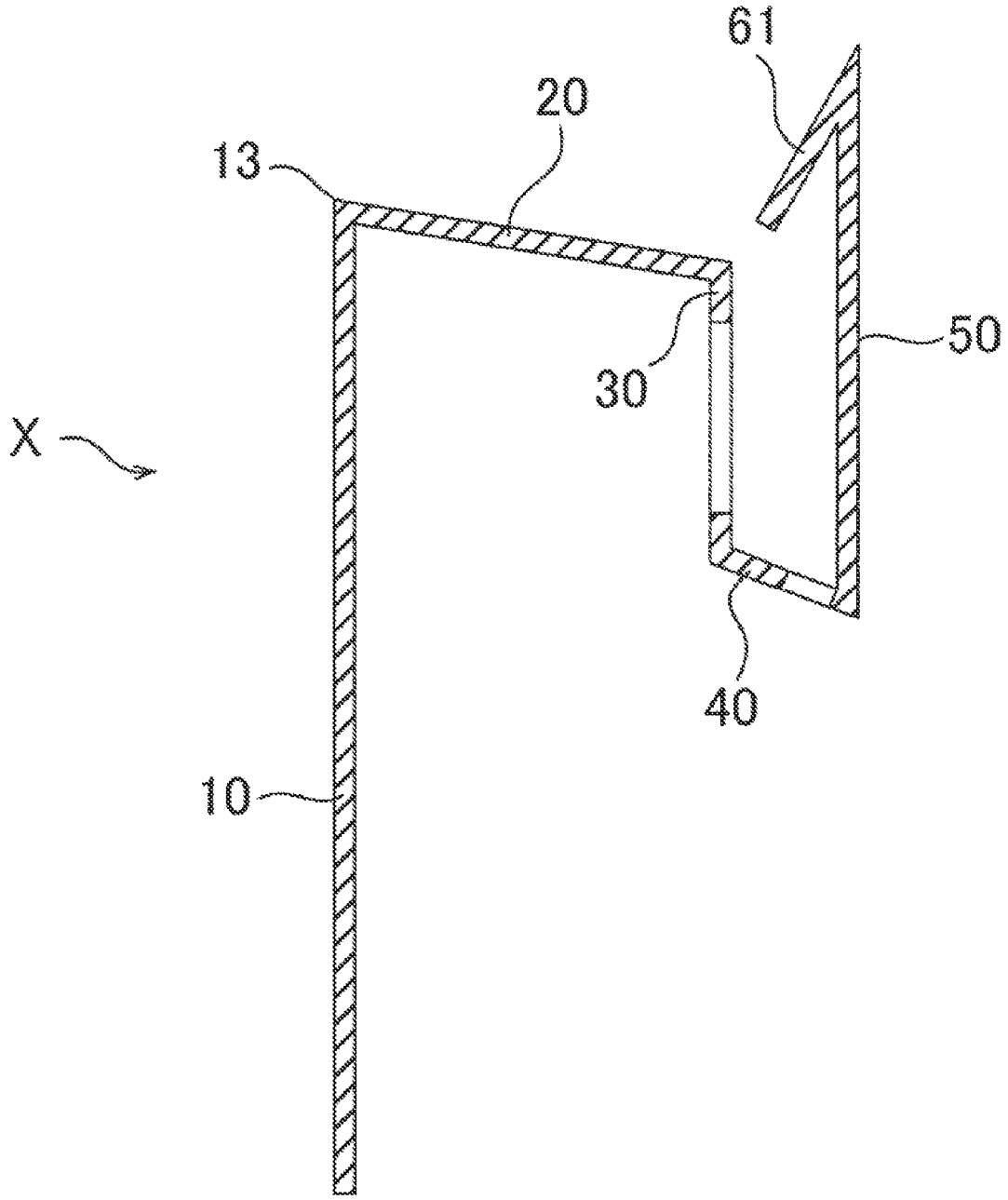

[FIG. 8]
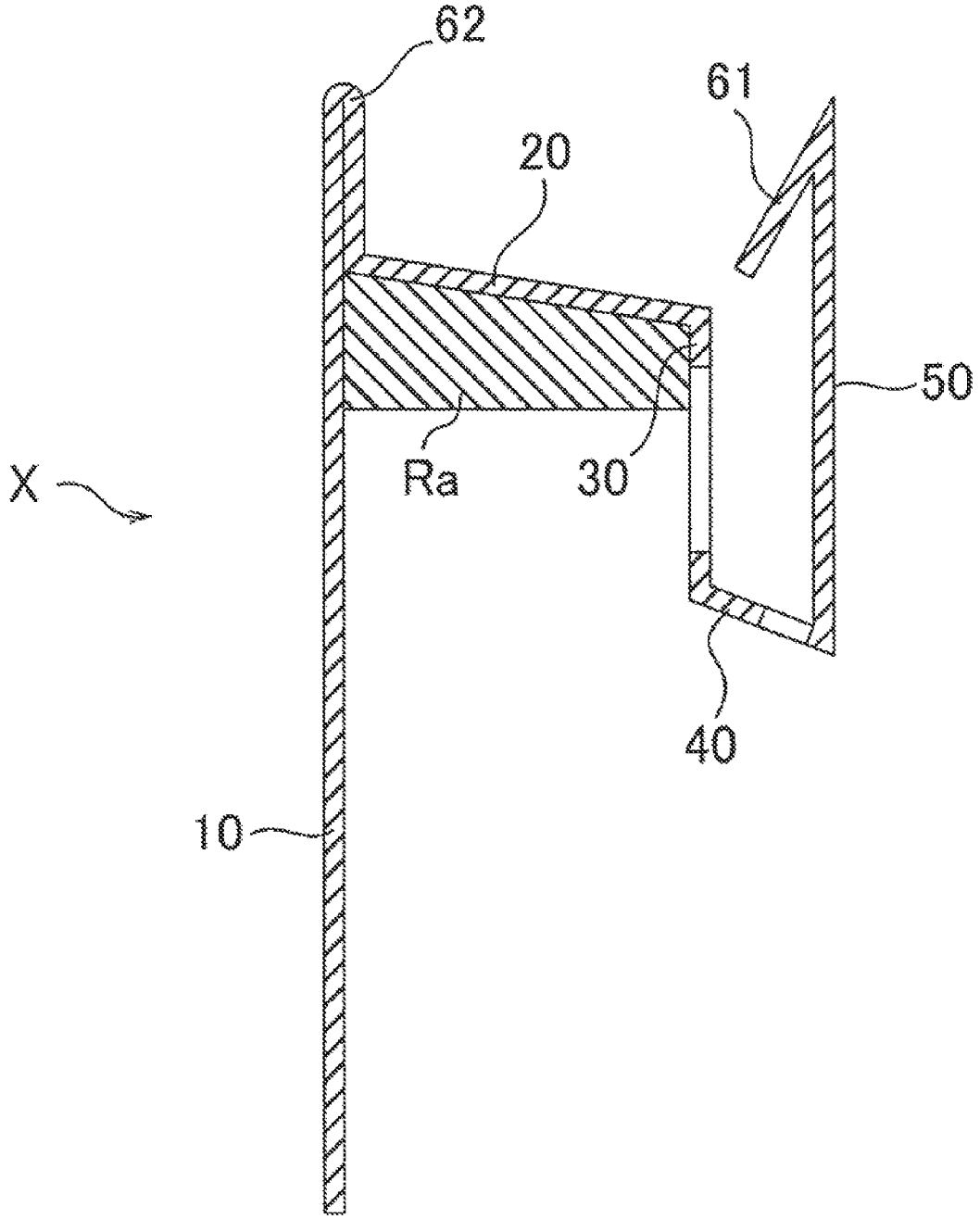

[FIG. 9]
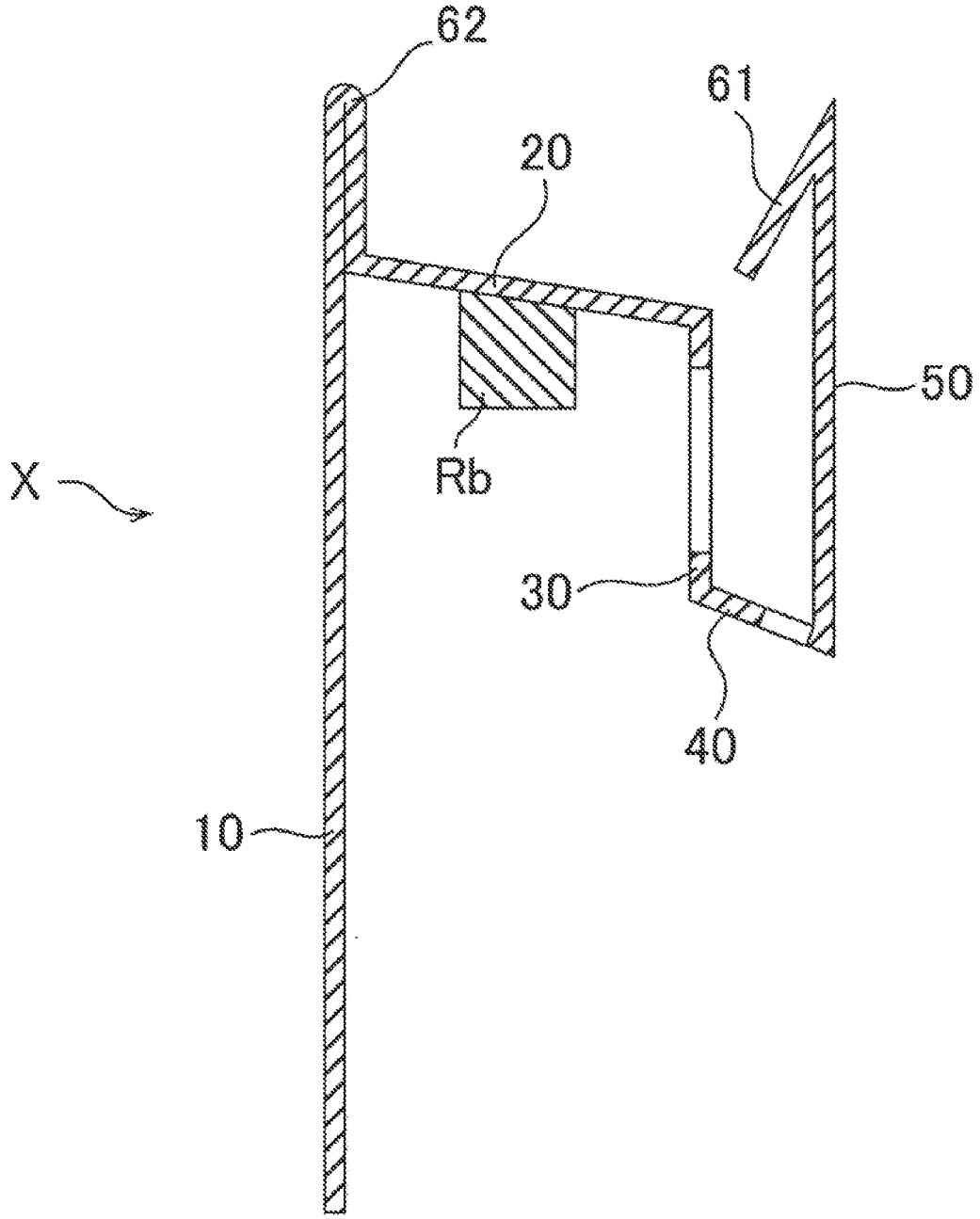

[FIG. 10]
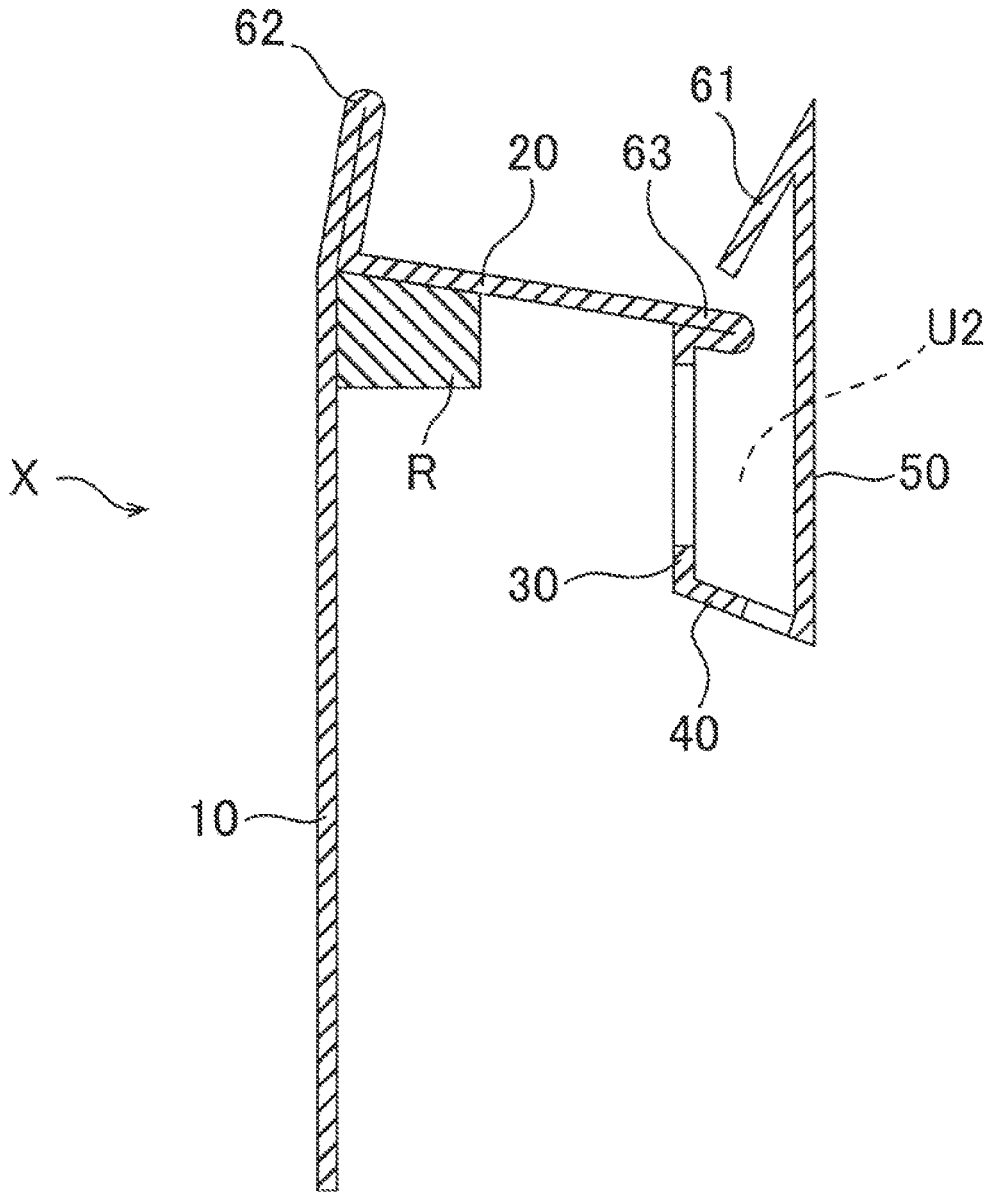

[FIG. 11]
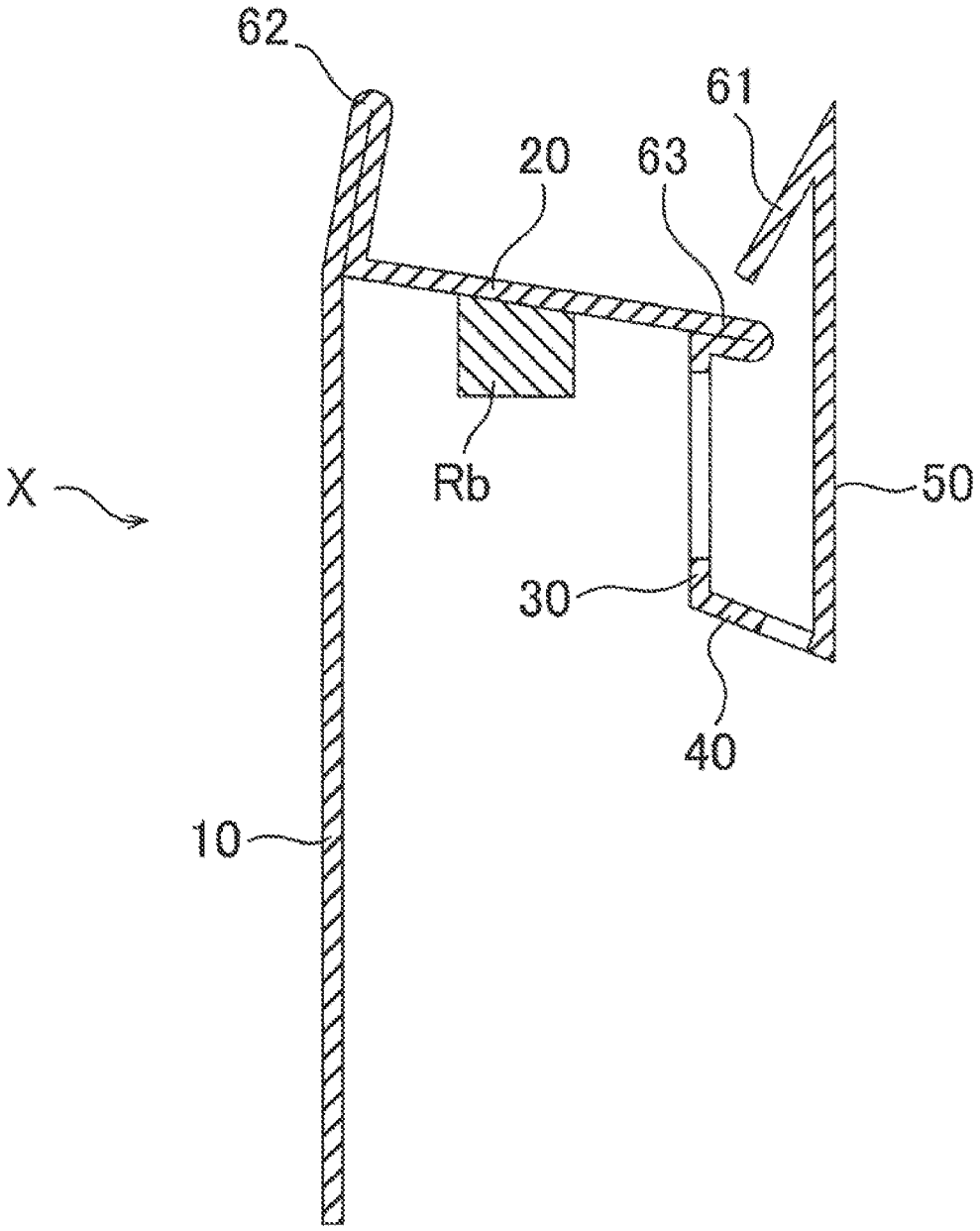

VENTILATION MEMBER AND WALL MATERIAL CONSTRUCTION STRUCTURE

TECHNICAL FIELD

The present invention relates to a ventilation member and a wall material construction structure.

BACKGROUND ART

Inorganic boards such as ceramic siding boards, metal siding boards, and ceramic boards may be used as wall materials for forming an exterior wall of a building. In constructing an exterior wall using wall materials, a plurality of wall materials are joined together in the up-down direction and the left-right direction.

In the case of thin wall materials such as ceramic siding boards, upper shiplap portions and lower shiplap portions for joining adjacent wall materials may sometimes be formed at end portions of the wall materials. However, due to the thinness of the shiplap portions, there are cases in which good water tightness may not be ensured at the joining portions between the wall materials. In addition, a wall structure for an exterior wall is often provided with a ventilation layer on the back side (indoor side) of the wall materials. When the pressure inside the ventilation layer is lower than the pressure of the outdoor air, water such as rainwater may enter from the outdoor side to the indoor side at the joined portion between the wall materials.

Meanwhile, vents for providing communication between the ventilation layer and the outdoors so as to increase the ventilation of the ventilation layer may sometimes be provided at an upper end portion and a lower end portion of the wall structure. Such vents suppress the occurrence of condensation inside the ventilation layer. An example of the technology related to the vents is described in Patent Document 1 below.

CITATION LIST

Patent Documents

Patent Document 1: JP 2018-91002A

SUMMARY OF INVENTION

Technical Problem

When such vents are provided in a wall structure, the difference between the pressure inside the ventilation layer and the outdoor pressure tends to be reduced. However, according to the conventional technology, as the distance between the upper and lower ends of the wall structure increases (e.g., as the number of wall materials joined in the up-down direction increases), the ventilation throughout the ventilation layer is less likely to be ensured, and a pressure difference tends to occur inside the ventilation layer. For example, the pressure in the central region of the ventilation layer in the up-down direction may be lower than the pressures in the other regions. The occurrence of such a pressure difference is also not desirable in terms of the above-described water tightness.

The present invention has been conceived under the above-described circumstances, and it is an object thereof to provide a ventilation member suitable for ensuring sufficient ventilation in a ventilation layer provided on the back side of a wall material, and a wall material construction structure in which such a ventilation member is used.

Solution to Problem

According to a first aspect of the present invention, a ventilation member is provided that can be attached to a wall material. The ventilation member includes a fixed plate portion, a top plate portion, a partition plate portion, a bottom plate portion, a front plate portion, and a first baffle plate portion.

The fixed plate portion has a first surface that abuts against a building framework, and a second surface on a side opposite to the first surface, and includes a first end portion located on one side in a state in which the ventilation member is attached to the wall material, and a second end portion located on another side. The top plate portion extends from the first end portion of the fixed plate portion on the second surface side. The partition plate portion extends from the top plate portion in a direction from the first end portion toward the second end portion.

The bottom plate portion extends from the partition plate portion in a direction away from the fixed plate portion. The front plate portion extends from the bottom plate portion in a direction from the second end portion toward the first end portion. The first baffle plate portion extends from the front plate portion to the partition plate portion side.

The fixed plate portion, the partition plate portion, and the top plate portion form a first opening into which an end portion of the wall material can be inserted. The partition plate portion, the front plate portion, and the bottom plate portion form a second opening that is open in a direction opposite to a direction in which the first opening is open. A first hole is formed in the bottom plate portion.

In constructing a wall structure, the ventilation member having the above-described configuration is used by being attached to a building framework in a state in which the first edge of the fixed plate portion is placed at the top. Specifically, in a state in which an end portion of the wall material is inserted into the above-described first opening of the ventilation member, the fixed plate portion is fixed to the building framework, together with the wall material in abutment against the second surface of the fixed plate portion of the ventilation member. For example, when a ventilation layer extending in the up-down direction along the wall material is formed on the indoor side of the wall material, the ventilation layer is in communication with the above-described second opening via a path along the back side of the wall material, the first surface side of the fixed plate portion, and the top plate portion. Also, when the wall material is inserted into the first opening in a state in which the wall material is spaced apart from the partition plate portion, the second opening and the ventilation layer are in communication with the outdoors via the first hole of the bottom plate portion.

A ventilation member that can be used in such a way is suitable for ensuring sufficient ventilation in the ventilation layer provided on the back side of the wall material.

When the present ventilation member is attached to an end portion of the wall material disposed at the lower position of two wall materials disposed adjacent to each other, for example, in the vicinity of the center of the wall structure in the up-down direction, and is used in the way described above, ventilation over the entire ventilation layers is likely to be ensured.

That is, the pressure in, for example, the central region in the up-down direction of the ventilation layer on the back side of the wall material of the wall structure is suppressed from being reduced to be lower than the pressures in the other regions, as a result of which the pressure difference is reduced in the up-down direction of the ventilation layer, and ventilation is thus ensured. Therefore, the entry of water such as rainwater to the back side (indoor side) of the wall material is prevented or suppressed.

Preferably, according to a second aspect, the top plate portion is inclined in a direction from the first end portion toward the second end portion, from the fixed plate portion to the partition plate portion. Such a configuration is suitable for suppressing water droplets such as condensed water from flowing toward the fixed plate portion on the top plate portion in the ventilation member, and hence is suitable for preventing or suppressing the entry of water to the back side of the wall material.

Preferably, according to a third aspect, the bottom plate portion is inclined in a direction from the first end portion toward the second end portion, from the partition plate portion to the front plate portion. Such a configuration is preferable from the viewpoint of the drainage in the second opening to the outdoors.

Preferably, according to a fourth aspect, the first baffle plate portion is located on a side of the top plate portion opposite to the bottom plate portion. Such a configuration is suitable for securing a ventilation path in communication with the first ventilation layer described above on a side of the top plate portion opposite to the bottom plate portion.

Preferably, according to a fifth aspect, the first baffle plate portion is inclined in a direction from the first end portion toward the second end portion, from the front plate portion to the partition plate portion side. Such a configuration is suitable for suppressing the seepage of water such as rainwater from the inside of the second opening to the top plate portion side, and hence is suitable for preventing or suppressing the entry of water to the back side of the wall material, i.e., the first surface side of the fixed plate portion.

Preferably according to a sixth aspect, the present ventilation member further includes a second baffle plate portion extending from the first end portion of the fixed plate portion toward a direction from the second end portion toward the first end portion. By including the second baffle plate portion, this configuration is suitable for suppressing the seepage of water such as rainwater entering from the second opening to the first surface side of the fixed plate portion beyond the top plate portion, and hence is suitable for preventing or suppressing the entry of water to the back side of the wall material.

More preferably, according to a seventh aspect, the second baffle plate portion is inclined to the top plate portion side relative to an extension surface of the fixed plate portion. Such a configuration reduces the angle formed by the second baffle plate portion and the top plate portion, and thus is suitable for further suppressing the flow of the ventilating air containing rainwater or the like toward the first surface of the fixed plate portion beyond the top plate portion.

Preferably, according to an eighth aspect, the present ventilation member further includes a third baffle plate portion extending from the top plate portion toward the second opening side. By including the third baffle plate portion, such a configuration is suitable for further suppressing the seepage of water such as rainwater from the inside of the second opening to the top plate portion side, and hence is suitable for preventing or suppressing the entry of water to the back side of the wall material.

Preferably according to a ninth aspect, the present ventilation member further includes, inside the first opening, a waterproofing member in abutment against the top plate portion. Such a configuration allows the waterproofing member and the end portion of the wall material to come into contact with each other, thereby preventing water from entering the back side of the wall material by traveling over the end portion of the wall material inside the first opening. That is, this configuration can prevent the entry of water from the first opening to the second surface side of the fixed plate portion, and is therefore suitable for further preventing or suppressing the entry of water to the back side of the wall material.

Preferably, according to a tenth aspect, the present ventilation member further includes a second hole in the partition plate portion. In this configuration, the above-described ventilation layer and the second opening are brought into communication with the outdoors by the second hole formed in the partition plate portion.

Preferably, according to an eleventh aspect, the present ventilation member further includes the first hole formed in the bottom plate portion and the second hole formed in the partition plate portion as a single hole. In this configuration, by forming a single hole spanning the first hole formed in the bottom plate portion and the second hole formed in the partition plate portion, the ventilation and the drainage in the second opening to the outdoors can be further enhanced.

According to a twelfth aspect, a wall material construction structure is provided. The wall material construction structure includes a building framework, a first wall material, and the above-described ventilation member according to the first aspect. The fixed plate portion of the ventilation member is fixed to the building framework in a state in which the first surface is in abutment against the building framework. An end portion of the first wall material is inserted into the first opening of the ventilation member in a state in which the end portion is spaced apart from the partition plate portion. A first ventilation layer extending in an up-down direction along the first wall material is formed on the building framework side of the first wall material, and the first opening and the second opening of the ventilation member are in communication with the first ventilation layer.

In such a wall material construction structure, the fixed plate portion of the ventilation member is fixed to the building framework, together with the first wall material, in a state in which the first ventilation layer extending in the up-down direction along the first wall material is formed on the indoor side of the first wall material. Accordingly, the first ventilation layer is in communication with the above-described second opening via a path along the back side of the wall material, the first surface side of the fixed plate portion, and the top plate portion. Also, the upper end portion of the first wall material is inserted into the first opening in a state in which the upper end portion is spaced apart from the partition plate portion, and therefore the first ventilation layer is in communication with the outdoors via the first hole of the bottom plate portion.

Such a wall material construction structure is suitable for ensuring sufficient ventilation in the ventilation layer (including the first ventilation layer) formed on the back side of the wall material, as described in relation to the first aspect.

Preferably according to a thirteenth aspect, the present wall material construction structure further includes: a second wall material located above the first wall material and attached to the building framework; and a flashing member.

The flashing member includes a flashing fixed plate portion, a flashing inclined plate portion, and a flashing plate portion. The flashing fixed plate portion is fixed to the building framework, above the fixed plate portion of the ventilation member. The flashing inclined plate portion is inclined downward from the flashing fixed plate portion so as to extend beyond a space between the first wall material and the second wall material. The flashing plate portion extends downward from a lower end of the flashing inclined plate portion, and is in abutment against a surface of the front plate portion of the ventilation member that is on a side opposite to the first baffle plate portion. A ventilation space is formed between the second wall material and the flashing inclined plate portion of the flashing member. A second ventilation layer extending in the up-down direction along the second wall material, and being in communication with the ventilation space is formed on the indoor side of the second wall material.

The present wall material construction structure further including such a flashing member is suitable for preventing or suppressing the entry of water such as rainwater to the back side of the wall material, while ensuring sufficient ventilation in the ventilation layer (including both the first ventilation layer and the second ventilation layer) formed on the back side of the wall materials.

When the ventilation member is attached to an upper end portion of the wall material at the lower position (first wall material) of two wall materials disposed adjacent to each other, for example, in the vicinity of the center of the wall material construction structure in the up-down direction, and the above-described flashing member is disposed between the wall material at the upper position (second wall material) and the first wall material, the effect of the twelfth aspect is provided. Furthermore, the first ventilation layer formed on the back side of the wall material at the lower position and the second ventilation layer formed on the back side of the wall material at the upper position are separated. Therefore, the wall material construction structure can further suppress the pressure difference in the up-down direction of the ventilation layer.

Preferably, according to a fourteenth aspect, the flashing plate portion extends below a lower end of the front plate portion of the ventilation member from the lower end of the flashing inclined plate portion. Such a configuration secures a space extending from the lower end of the flashing plate portion to the bottom plate portion of the ventilation member, and thus is suitable for further suppressing the entry of rainwater or the like to the first opening and the second opening of the ventilation member.

BRIEF DESCRIPTION OF DRAWINGS

FIG. 1 is a perspective view (partially cutaway perspective view) of a ventilation member according to an embodiment of the present invention.

FIG. 2 is a partially enlarged perspective view (partially cutaway perspective view) of the ventilation member shown in FIG. 1.

FIG. 3 is a cross-sectional view taken along the line of the ventilation member shown in FIG. 2.

FIG. 4 is a perspective view of a wall material construction structure according to an embodiment of the present invention.

FIG. 5 is a vertical cross-sectional view of the wall material construction structure shown in FIG. 4.

FIG. 6 is a cross-sectional view of a wall material construction structure according to an embodiment of the present invention.

FIG. 7 is a cross-sectional view of a modification of the ventilation member.

FIG. 8 is a cross-sectional view of a modification of the ventilation member.

FIG. 9 is a cross-sectional view of a modification of the ventilation member.

FIG. 10 is a cross-sectional view of a modification of the ventilation member.

FIG. 11 is a cross-sectional view of a modification of the ventilation member.

DESCRIPTION OF EMBODIMENTS

FIGS. 1 to 3 show a ventilation member X according to an embodiment of the present invention.

The ventilation member X is a ventilation member that can be attached to an upper end portion of a wall material, and includes a fixed plate portion 10, a top plate portion 20, a partition plate portion 30, a bottom plate portion 40, a front plate portion 50, a first baffle plate portion 61, a second baffle plate portion 62, and a waterproofing member R. The fixed plate portion 10, the top plate portion 20, and the partition plate portion 30 form a downward opening U1 (first opening) into which the upper end portion of the wall material can be inserted. The partition plate portion 30, the bottom plate portion 40, and the front plate portion 50 form an upward opening U2 (second opening).

The fixed plate portion 10 has a first surface 11 that abuts against a building framework, and a second surface 12 on a side opposite to the first surface 11. In addition, the fixed plate portion 10 has a first edge 13 (first end portion) located on the upper side in an up-down direction D in a state in which the ventilation member X is attached to the upper end portion of the wall material, and a second edge 14 (second end portion) located on the lower side. In the present embodiment, a direction from the first edge 13 toward the second edge 14 is the downward direction in the up-down direction D. Similarly, a direction from the second edge 14 toward the first edge 13 is the upward direction in the up-down direction D.

The top plate portion 20 extends from the first edge 13 of the fixed plate portion 10 on the second surface 12 side, and has a third edge 21 (third end portion) at its extension end. In addition, the top plate portion 20 has a third surface 22 on the downward opening U1 side, and a fourth surface 23 on a side opposite to the third surface 22. The third surface 22 is opposed to a wall material in a state in which the wall material is inserted in the downward opening U1 of the ventilation member X. In the present embodiment, the top plate portion 20 is inclined downward in the up-down direction D from the fixed plate portion 10 to the partition plate portion 30.

Note that in the present embodiment, the ventilation member X is formed by bending a steel material 1 as will be described later. This results in clear boundaries between the members, and therefore the first end portion constituting the boundary between the fixed plate portion 10 and the top plate portion 20 is referred to as the first edge 13, and the second end portion constituting the lower end of the fixed plate portion 10 is referred to as the second edge 14.

The partition plate portion 30 extends downward in the up-down direction D from the third edge 21 of the top plate portion 20, and has a fourth edge 31 at its extension end. In addition, the partition plate portion 30 has a plurality of ventilation holes 34 (second holes).

The bottom plate portion 40 extends from the fourth edge 31 of the partition plate portion 30 in a direction away from the fixed plate portion 10, and has a fifth edge 41 (fifth end portion) at its extension end. In addition, the bottom plate portion 40 has a plurality of drain holes 42 (first holes). In the present embodiment, the bottom plate portion 40 is inclined downward in the up-down direction D from the partition plate portion 30 to the front plate portion 50.

The front plate portion 50 extends upward from the fifth edge 41 of the bottom plate portion 40 in the up-down direction D, and has a sixth edge 51 (sixth end portion) at its extension end (in FIGS. 1 and 2, a first baffle plate portion 61, which will be described later, is also shown to be partly cutaway, together with the front plate portion 50). In addition, the front plate portion 50 has a fifth surface 52 on the partition plate portion 30 side, and a sixth surface 53 on a side opposite to the fifth surface 52.

The first baffle plate portion 61 extends from the sixth edge 51 of the front plate portion 50 to the partition plate portion 30 side. In the present embodiment, the first baffle plate portion 61 is located above the top plate portion 20 in the up-down direction D. Also, in the present embodiment, the first baffle plate portion 61 is inclined downward in the up-down direction D from the front plate portion 50 to the partition plate portion 30 side.

The second baffle plate portion 62 extends toward the upper side in the up-down direction D from the first edge 13 of the fixed plate portion 10. The second baffle plate portion 62 has a plurality of cut-outs 62*a*.

The waterproofing member R is attached to the third surface 22 of the top plate portion 20 inside the downward opening U1. The waterproofing member R is formed, for example, of a foamed resin material. Examples of such a material include a foamed ethylene-propylene-diene rubber (EPDM).

The fixed plate portion 10, the top plate portion 20, the partition plate portion 30, the bottom plate portion 40, the front plate portion 50, the first baffle plate portion 61, and the second baffle plate portion 62 of the ventilation member X can be formed, for example, by forming, through punching, the necessary holes such as the ventilation holes 34 and the drain holes 42 in a single steel plate that has been cut in predetermined dimensions and shape, and thereafter bending the steel plate. The waterproofing member R is bonded to the third surface 22 of the top plate portion 20, for example, using an adhesive, before or after the bending.

FIGS. 4 and 5 show a wall material construction structure Y1 that is constructed using the ventilation member X. FIG. 4 is a perspective view of the wall material construction structure Y1, and FIG. 5 is a vertical cross-sectional view of the wall material construction structure Y1. In FIG. 4, the vertically upward direction is indicated as "UP", and the vertically downward direction is indicated as "DOWN". In addition, the horizontally leftward direction in a direction from the outdoors toward the indoors in FIG. 4 is indicated as "LEFT", and the horizontally rightward direction is indicated as "RIGHT". The up-down direction and the indoor-outdoor direction in FIG. 5 are indicated so as to correspond to FIG. 4.

In the present embodiment, the wall material construction structure Y1 includes a building framework 100, a plurality of wall materials W, a ventilation member X, a spacer 70, a support 80, and a flashing member 90. The wall material construction structure Y1 is a structure in which a plurality of wall materials W are attached to a building framework 100 constituting a residence, a facility a warehouse, or the like in the upward, downward, leftward, and rightward directions. The building framework 100 may constitute a newly-built building, or may constitute an existing building for which renovation of a heat insulation material or an exterior wall is performed.

In the present embodiment, the building framework 100 is a steel framework structure in which a plurality of steel materials 1 are arranged as support members (horizontal furring strips) extending in the left-right direction. Examples of the steel material 1 include C-shaped steel and a square steel pipe. In the present embodiment, a case where the steel material 1 is a C-shaped steel is illustratively shown. In the present embodiment, a moisture-permeable waterproof sheet 2 is stretched between the plurality of steel materials 1 on the indoor side of the steel material 1.

The wall material W is an inorganic board such as a ceramic siding board and a metal siding board. Of the two wall materials W shown in FIGS. 4 and 5, a first wall material W1 located at the lower position is attached to the ventilation member X. Specifically, the first wall material W1 is inserted into the downward opening U1 of the ventilation member X in a state in which an upper end portion of the first wall material W1 is spaced apart from the partition plate portion 30, and in a state in which the upper end portion is in abutment against the waterproofing member R. Of the two wall materials W shown in FIGS. 4 and 5, a second wall material W2 located at the upper position has an upper shiplap portion Wa on its lower end side. The first wall material W1 and the second wall material W2 each have a plate thickness of 15 to 25 mm, for example.

The ventilation member X is attached, via the spacer 70, to a steel material 1 (steel material 1A) on the lower side in the drawings in a state in which the ventilation member X is attached to the upper end portion of the first wall material W1. Specifically, the ventilation member X and the first wall material W1 are attached to the steel material 1 constituting a part of the building framework 100, using, for example, a drill screw extending, from the outdoor side, the first wall material W1, the spacer 70, the moisture-permeable waterproof sheet 2, and a part of the steel material 1A. The spacer 70 extends in the left-right direction, and has a large number of through holes 71 extending therethrough in the up-down direction.

A first ventilation layer P1 is formed between the building framework 100 and the first wall material W1 attached to the building framework 100 in a state in which the ventilation member X is attached thereto. Specifically, the first ventilation layer P1 is a ventilation path extending in the up-down direction along the first wall material W1 on the back side (indoor side) of the first wall material W1. In addition, the first ventilation layer P1 is in communication with the second holes 34 of the ventilation member X, as will be described later. In a state in which such a first ventilation layer P1 is formed, the ventilation member X is fixed to the building framework 100, together with the first wall material W1.

The support 80 and the flashing member 90 are attached to a steel material 1 (steel material 1B) on the upper side in the drawings. Specifically, the support 80 and the flashing member 90 are attached to the steel material 1B constituting a part of the building framework 100, using, for example, a drill screw extending, from the outdoor side, through the support 80, the flashing member 90, the moisture-permeable waterproof sheet 2, and a part of the steel material 1B.

The support 80 includes a supporting plate portion 81 including an engaging edge 81*a* having a shape that is bent or curved to the upper side. The support 80 or the supporting plate portion 81 thereof supports the lower end side of the second wall material W2 such that the engaging edge 81*a* engages with a step-shaped portion of the upper shiplap portion Wa of the second wall material W2. A plurality of ventilation holes 81*b* are formed in the supporting plate portion 81. In addition, the upper end side of the second wall material W2 is attached, via a predetermined fastener, to a steel material 1 (not shown) disposed at an upper position than the steel material 1B, for example. A second ventilation layer P2 is formed between such a second wall material W2 and the building framework 100. The second ventilation layer P2 extends in the up-down direction along the second wall material W2 on the back side (indoor side) of the second wall material W2.

The flashing member 90 includes a flashing fixed plate portion 91, a flashing inclined plate portion 92, and a flashing plate portion 93. The flashing fixed plate portion 91 is fixed to the steel material 1B constituting a part of the building framework 100, above the fixed plate portion 10 of the ventilation member X. As shown in FIG. 5, a waterproof tape 3 may be attached over the upper end side of the flashing fixed plate portion 91 and the moisture-permeable waterproof sheet 2. The flashing inclined plate portion 92 is inclined downward from the flashing fixed plate portion 91 so as to extend beyond the outdoor side between the first wall material W1 and the second wall material W2. The flashing plate portion 93 extends downward from a lower end 92*a* of the flashing inclined plate portion 92, and is in abutment against the sixth surface 53 (i.e., the surface of the front plate portion 50 that is on a side opposite to the first baffle plate portion 61) of the front plate portion 50 of the ventilation member X. In the present embodiment, the flashing plate portion 93 extends downward from the lower end 92*a* of the flashing inclined plate portion 92 beyond the front plate portion 50 of the ventilation member X.

A ventilation space G is formed between the flashing inclined plate portion 92 of such a flashing member 90 and the second wall material W2. The above-described second ventilation layer P2 extending in the up-down direction along the second wall material W2 on the back side of the second wall material W2 is in communication with the ventilation space G.

In the above-described wall material construction structure Y1, the fixed plate portion 10 of the ventilation member X is fixed to the building framework 100, together with the first wall material W1, in a state in which the first ventilation layer P1 extending in the up-down direction along the first wall material W1 is formed on the indoor side of the first wall material W1, as described above. The first ventilation layer P1 is in communication with the upward opening U2 of the ventilation member X via a path extending along the first surface 11 side of the fixed plate portion 10, the second baffle plate portion 62, and the fourth surface 23 side (the back side of a surface of the top plate portion 20 that is opposed to the first wall material W1) of the top plate portion 20. Also, the upper end portion of the first wall material W1 is inserted into the downward opening U1 in a state in which the upper end portion is spaced apart from the partition plate portion 30, and therefore the ventilation holes 34 of the partition plate portion 30 partitioning the upward opening U2 and the downward opening U1 are substantially open to the outdoor side. Accordingly, the first ventilation layer P1 is in further communication with the outdoors as well via such ventilation holes 34. Additionally, the first ventilation layer P1 is in communication with the outdoors also via the drain holes 42 of the bottom plate portion 40.

In the wall material construction structure Y1, as described above, the ventilation space G is formed between the second wall material W2 and the flashing inclined plate portion 92 of the flashing member 90, and the second ventilation layer P2 extending in the up-down direction along the second wall material W2 on the indoor side of the second wall material W2 is in communication with the ventilation space G. The second ventilation layer P2 is in communication with the outside via the ventilation holes 81*b* and the ventilation space G.

Such a wall material construction structure Y1 is suitable for ensuring sufficient ventilation in the ventilation layer (including the first ventilation layer P1 and the second ventilation layer P2) formed on the back side of the wall materials. When the first wall material W1 and the second wall material W2 described above are two wall materials disposed adjacent to each other, for example, in the vicinity of the center of the wall material construction structure Y1 in the up-down direction, ventilation over the entire ventilation layer is likely to be ensured. The pressure in, for example, the central region in the up-down direction of the ventilation layer on the back side of the wall materials of such a structure is suppressed from being reduced to be lower than the pressures in the other regions, as a result of which the pressure difference is reduced in the up-down direction of the ventilation layer, and ventilation is thus ensured. Therefore, the wall material construction structure Y1 is suitable for suppressing or preventing the entry of water such as rainwater to the back side of the wall materials.

In the wall material construction structure Y1, as described above, the top plate portion 20 of the ventilation member X is inclined downward in the up-down direction from the fixed plate portion 10 to the partition plate portion 30. Such a configuration is suitable for suppressing water droplets such as condensed water from flowing toward the fixed plate portion 10 on the top plate portion 20 in the ventilation member X, and hence is suitable for preventing or suppressing the entry of water to the back side of the wall materials.

As described above, the bottom plate portion 40 of the ventilation member X is inclined downward in the up-down direction from the partition plate portion 30 to the front plate portion 50. Such a configuration is preferable from the viewpoint of drainage of the upward opening U2 to the outdoors.

As described above, the first baffle plate portion 61 of the ventilation member X is located above the top plate portion 20 in the up-down direction. Such a configuration is suitable for securing, above the top plate portion 20, a ventilation path in communication with the first ventilation layer P1 described above. In addition, as described above, the first baffle plate portion 61 is inclined in the up-down direction from the front plate portion 50 to the partition plate portion 30 side. Such a configuration is suitable for suppressing the seepage of water such as rainwater from the inside of the second opening U2 to the top plate portion 20 side, and hence is suitable for preventing or suppressing the entry of water to the back side of the wall materials.

As described above, the ventilation member X further includes a second baffle plate portion 62 extending toward the upper side in the up-down direction from the first edge 13 of the fixed plate portion 10. Since the second baffle plate portion 62 extends toward the upper side in the up-down direction from the first edge 13 of the fixed plate portion 10 in the ventilation member X, such a configuration is suitable for suppressing water droplets such as condensed water from flowing toward the fixed plate portion 10 on the top plate portion 20, and hence is suitable for preventing or suppressing the entry of water to the back side of the wall materials. In addition, the second baffle plate portion 62 has a plurality of cut-outs 62*a*, as described above. Such a configuration is suitable for ensuring the flowability of the air between the first surface 11 side of the fixed plate portion 10 and the fourth surface 23 side of the top plate portion 20, and thus is useful in ensuring the above-described ventilation regarding the first ventilation layer P1.

As described above, the ventilation member X includes a waterproofing member R, on the third surface 22 of the top plate portion 20 inside the downward opening U1. Such a configuration is suitable for preventing or suppressing the entry of water from the outdoor side of the wall material to the indoor side of the wall material by the waterproofing member R.

As shown in FIG. 6, the ventilation member X can also be used for a wall material construction structure (wall material construction structure Y2) at a soffit portion an underside part of a portion projecting outside an exterior wall of a building) of the building framework 100. In FIG. 6, the vertically upward direction is indicated as "UP", the vertically downward direction is indicated as "DOWN", the indoor direction is indicated as "INDOOR", and the outdoor direction is indicated as "OUTDOOR".

In the wall material construction structure Y2, the first wall material W1 is inserted into the downward opening U1 of the ventilation member X in a state in which the upper end portion of the first wall material W1 is spaced apart from the partition plate portion 30. The ventilation member X is attached to a steel material 1 (steel material 1A) via the spacer 70 in a state in which the upper end portion of the first wall material W1 is inserted into the downward opening U1. Specifically the ventilation member X and the first wall material W1 are attached to the steel material 1 constituting a part of the building framework 100, using, for example, a drill screw extending, from the outdoor side, through the first wall material W1, the spacer 70, the moisture-permeable waterproof sheet 2, and a part of the steel material 1. The spacer 70 extends in the left-right direction, and has a large number of through holes 71 extending therethrough in the up-down direction.

A first ventilation layer P1 is formed between the building framework 100 and the first wall material W1 attached to the building framework 100. Specifically, the first ventilation layer P1 is a ventilation path extending in the up-down direction along the first wall material W1 on the back side (indoor side) of the first wall material W1. In addition, the first ventilation layer P1 is in communication with the ventilation holes 34 of the ventilation member X. The ventilation member X is fixed to the building framework 100, together with the first wall material W1, in a state in which such a first ventilation layer P1 is formed.

In the wall material construction structure Y2, the ventilation member X is disposed in abutment against a soffit material 4. The sixth end portion 51 of the front plate portion 50 and an upper end of the second baffle plate portion 62 of the ventilation member X are in abutment against the soffit material 4. As described above, the second baffle plate portion 62 has a plurality of cut-outs 62*a*. The cut-outs 62*a* form a ventilation path between the first surface 11 side of the fixed plate portion 10 and the fourth surface 23 side of the top plate portion 20. In addition, as shown in FIG. 6, the soffit material 4 is fixed to a steel material 1 (steel material 10, for example, using a drill screw.

As described above, in the above-described wall material construction structure Y2, the fixed plate portion 10 of the ventilation member X is fixed to the building framework 100, together with the first wall material W1, in a state in which the first ventilation layer P1 extending in the up-down direction along the first wall material W1 is formed on the indoor side of the first wall material W1. The first ventilation layer P1 is in communication with the upward opening U2 of the ventilation member X via a path extending along the first surface 11 side of the fixed plate portion 10, the cut-outs 62*a* of the second baffle plate portion 62, and the fourth surface 23 side (the back side of a surface of the top plate portion 20 that is opposed to the first wall material W1) of the top plate portion 20. Also, the upper end portion of the first wall material W1 is inserted into the downward opening U1 in a state in which the upper end portion is spaced apart from the partition plate portion 30, and therefore the ventilation holes 34 of the partition plate portion 30 partitioning the upward opening U2 and the downward opening U1 are substantially open to the outdoor side. Accordingly the first ventilation layer P1 is in further communication with the outdoors via such ventilation holes 34. Additionally, the first ventilation layer P1 is in communication with the outdoors also via the drain holes 42 of the bottom plate portion 40 that are responsible for the drainage of the upward opening U2.

Such a wall material construction structure Y2 is suitable for ensuring sufficient ventilation in the ventilation layer (including the first ventilation layer P1) formed on the back side of the wall materials.

FIGS. 7 to 11 show modifications of the ventilation member X that can be used in construction of wall materials in the above-described manner, for example.

As shown in FIG. 7, the ventilation member X does not need to include the second baffle plate portion 62. Also, as shown in FIG. 7, for example, the ventilation member X does not need to include the waterproofing member R.

The ventilation member X may include a waterproofing member Ra as shown in FIG. 8, for example, in place of the waterproofing member R described above. The waterproofing member Ra is provided over the entirety of the third surface 22 of the top plate portion 20. With such a waterproofing member Ra, the waterproofing performance inside downward opening U1 is likely to be ensured in a state in which the upper end portion of the wall material is inserted in the downward opening U1 of the ventilation member X.

The ventilation member X may include a waterproofing member Rb as shown in FIG. 9, for example, in place of the waterproofing member R described above. The waterproofing member Rb is provided at a portion halfway between the fixed plate portion 10 and the partition plate portion 30 on the third surface 22 of the top plate portion 20. With such a waterproofing member Rb as well, the waterproofing performance inside the downward opening U1 can be ensured in a state in which the upper end portion of the wall material is inserted in the first opening U1 of the ventilation member X.

As shown in FIG. 10, for example, the second baffle plate portion 62 of the ventilation member X may be inclined to the top plate portion 20 side relative to an extension surface of the fixed plate portion 10. Such a configuration is suitable for suppressing water droplets such as condensed water from flowing toward the fixed plate portion 10 on the top plate portion 20 in the ventilation member X, and hence is suitable for preventing or suppressing the entry of water to the back side of the wall materials.

As shown in FIG. 10, for example, the ventilation member X may further include a third baffle plate portion 63 extending from the third end portion 21 of the top plate portion 20 toward the upward opening U2 side. Such a configuration is suitable for suppressing the seepage of water such as rainwater from the inside of the second opening U2 to the top plate portion 20 side, and hence is suitable for preventing or suppressing the entry of water to the back side of the wall materials.

As shown in FIG. 11, for example, in the ventilation member X, the second baffle plate portion 62 may be inclined to the top plate portion 20 side relative to an extension surface of the fixed plate portion 10, and the ventilation member X may include the above-described waterproofing member Rb in place of the above-described waterproofing member R, and further include the above-described third baffle plate portion 63.

In the ventilation member X, the fixed plate portion 10, the top plate portion 20, the partition plate portion 30, the bottom plate portion 40, and so forth each have a flat-plate shape as described above, but may each have a curved shape such as an arc shape.

Furthermore, in the above-described embodiment, the drain holes 42 as the first holes that are formed in the bottom plate portion 40, and the ventilation holes 34 as the second holes that are formed in the partition plate portion 30 are formed as separated holes; however, these holes may be formed as a single hole spanning the bottom plate portion 40 and the partition plate portion 30. This can further improve the ventilation and the drainage in the second opening to the outdoors.

LIST OF REFERENCE NUMERALS

X Ventilation member
10 Fixed plate portion
11 First surface
12 Second surface
13 First edge (first end portion)
14 Second edge (second end portion)
20 Top plate portion
21 Third edge (third end portion)
30 Partition plate portion
31 Fourth edge (fourth end portion)
34 Ventilation hole (second hole)
40 Bottom plate portion
41 Fifth edge (fifth end portion)
42 Drain hole (first hole)
50 Front plate portion
51 Sixth edge (sixth end portion)
61 First baffle plate portion
62 Second baffle plate portion
63 Third baffle plate portion
R Waterproofing member
U1 Downward opening (first opening)
U2 Upward opening (second opening)
Y1, Y2 Wall material construction structure
W Wall material
W1 First wall material
W2 Second wall material
Wa Upper shiplap portion
P1 First ventilation layer
P2 Second ventilation layer
70 Spacer
80 Support
90 Flashing member
91 Flashing fixed plate portion
92 Flashing inclined plate portion
93 Flashing plate portion
G Ventilation space

The invention claimed is:

1. A ventilation member configured to be attached to a wall material, comprising:

a fixed plate portion having a first surface that abuts against a building framework, and a second surface on a side opposite to the first surface, and including a first end portion located on one side in a state in which the ventilation member is attached to the wall material, and a second end portion located on another side;

a top plate portion extending from the first end portion of the fixed plate portion on the second surface side;

a partition plate portion extending from the top plate portion in a direction from the first end portion toward the second end portion;

a bottom plate portion extending from the partition plate portion in a direction away from the fixed plate portion;

a front plate portion extending from the bottom plate portion in a direction from the second end portion toward the first end portion; and a first baffle plate portion extending from the front plate portion to the partition plate portion side, wherein the fixed plate portion, the partition plate portion, and the top plate portion define a first opening into which an end portion of the wall material is configured to be inserted, the partition plate portion, the front plate portion, and the bottom plate portion define a second opening that is open in a direction opposite to a direction in which the first opening is open, and a first hole is located in the bottom plate portion and a second hole is located in the partition plate portion.

2. The ventilation member according to claim 1, wherein the top plate portion is inclined in a direction from the first end portion toward the second end portion, from the fixed plate portion to the partition plate portion.

3. The ventilation member according to claim 1, wherein the bottom plate portion is inclined in a direction from the first end portion toward the second end portion, from the partition plate portion to the front plate portion.

4. The ventilation member according to claim 1, wherein the first baffle plate portion is located on a side of the top plate portion opposite to the bottom plate portion.

5. The ventilation member according to claim 1, wherein the first baffle plate portion is inclined in a direction from the first end portion toward the second end portion, from the front plate portion to the partition plate portion side.

6. The ventilation member according to claim 1, comprising a third baffle plate portion extending from the top plate portion toward the second opening side.

7. The ventilation member according to claim 1, comprising, inside the first opening, a waterproofing member in abutment against the top plate portion.

8. The ventilation member according to claim 1, wherein the first hole located in the bottom plate portion and the second hole located in the partition plate portion define a single hole.

9. The ventilation member according to claim 1, comprising a second baffle plate portion extending from the first end portion of the fixed plate portion toward a direction from the second end portion toward the first end portion.

10. The ventilation member according to claim 9, wherein the second baffle plate portion is inclined to the top plate portion side relative to an extension surface of the fixed plate portion.

11. A wall material construction structure comprising:

a building framework;

a first wall material; and the ventilation member according to claim 1, wherein the fixed plate portion of the ventilation member is fixed to the building framework in a state in which the first surface is in abutment against the building framework, an end portion of the first wall material is inserted into the first opening of the ventilation member in a state in which the end portion is spaced apart from the partition plate portion, a first ventilation layer extending in an up-down direction along the first wall material is formed on the building framework side of the first wall material, and the first opening and the second opening are in communication with the first ventilation layer.

12. The wall material construction structure according to claim 11, comprising:

a second wall material located above the first wall material and attached to the building framework; and a flashing member, wherein the flashing member includes:

a flashing fixed plate portion fixed to the building framework, above the fixed plate portion of the ventilation member;

a flashing inclined plate portion inclined downward from the flashing fixed plate portion so as to extend beyond a space between the first wall material and the second wall material; and a flashing plate portion extending downward from a lower end of the flashing inclined plate portion, and being abutment against a surface of the front plate portion of the ventilation member that is on a side opposite to the first baffle plate portion, a ventilation space is formed between the second wall material and the flashing inclined plate portion of the flashing member, and a second ventilation layer extending in the up-down direction along the second wall material and being in communication with the ventilation space is formed on the building framework side of the second wall material.

13. The wall material construction structure according to claim 12, wherein the flashing plate portion extends below a lower end of the front plate portion of the ventilation member from the lower end of the flashing inclined plate portion.

* * * * *